US010680359B2

(12) United States Patent
Geske

(10) Patent No.: US 10,680,359 B2
(45) Date of Patent: Jun. 9, 2020

(54) PLUG CONTACT

(71) Applicant: Phoenix Contact GmbH & Co. KG, Blomberg (DE)

(72) Inventor: Ralf Geske, Schieder-Schwalenberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/095,484

(22) PCT Filed: Apr. 21, 2017

(86) PCT No.: PCT/EP2017/059524
§ 371 (c)(1),
(2) Date: Oct. 22, 2018

(87) PCT Pub. No.: WO2017/182633
PCT Pub. Date: Oct. 26, 2017

(65) Prior Publication Data

US 2019/0123462 A1 Apr. 25, 2019

(30) Foreign Application Priority Data

Apr. 22, 2016 (DE) ..... 10 2016 107 482.9

(51) Int. Cl.
*H01R 12/58* (2011.01)
*H01R 12/51* (2011.01)

(52) U.S. Cl.
CPC ..... *H01R 12/585* (2013.01); *H01R 12/515* (2013.01)

(58) Field of Classification Search
CPC .... H01R 12/585; H01R 12/515; H01R 9/092; H01R 9/24; H01R 4/36; H01R 4/4818; H01R 4/4827
(Continued)

(56) References Cited

U.S. PATENT DOCUMENTS 4,836,806 A * 6/1989 Dougherty ..... H01R 12/585 439/751
5,669,792 A 9/1997 Naka et al.
(Continued)

FOREIGN PATENT DOCUMENTS

DE 3715893 A1 12/1988
DE 20218295 U1 4/2003
(Continued)

*Primary Examiner* — Gary F Paumen
(74) *Attorney, Agent, or Firm* — David S. Safran; Roberts Calderon Safran & Cole, P.C.

(57) ABSTRACT

A plug contact for electrically contacting a printed circuit board by plugging the contact into a contact hole of the printed circuit board, has two contact limbs which are elastic relative to each other, a terminal region, and a connection region. The connection region connects the contact limbs together and to the terminal region, the plug contact being punched out of flat metal material and bent. The plug contact ensures multiple plugging and pulling cycles without the inner wall of the contact hole being damaged by each of the contact limbs being a contacting region which contacts the contact hole in the plugged-in state. The outer contour of each of the contact limbs is shaped as a segment of a circle in a cross-sectional view in the contacting region, the radius of the outer contour being smaller than the radius of the corresponding contact hole of the printed circuit board.

10 Claims, 9 Drawing Sheets

(58) Field of Classification Search
USPC ..... 439/709, 441, 82, 751
See application file for complete search history.

(56) References Cited

U.S. PATENT DOCUMENTS

| | | | | |
|---|---|---|---|---|
| 5,709,556 | A * | 1/1998 | Tan | H01R 12/7029 439/567 |
| 7,252,534 | B2 | 8/2007 | Reibke | |
| 8,821,174 | B2 * | 9/2014 | Kimura | H01R 13/6315 439/248 |
| 8,840,408 | B2 * | 9/2014 | Baba | H01R 12/58 439/83 |
| 9,276,338 | B1 | 3/2016 | Dariavach et al. | |
| 10,461,454 | B2 * | 10/2019 | Geske | H01R 12/585 |
| 2007/0099479 | A1 * | 5/2007 | Holterhoff | H01R 4/4836 439/441 |
| 2009/0017702 | A1 * | 1/2009 | Pizzi | H01R 4/363 439/812 |
| 2013/0115790 | A1 | 5/2013 | Baba et al. | |

FOREIGN PATENT DOCUMENTS

| | | | |
|---|---|---|---|
| DE | 102008046583 | A1 | 3/2010 |
| DE | 102011011017 | A1 | 8/2012 |
| EP | 2690715 | A1 | 1/2014 |
| JP | S62180873 | U | 11/1987 |
| JP | H09266019 | A | 10/1997 |
| JP | 2008041384 | A | 2/2008 |
| WO | 9005392 | A1 | 5/1990 |
| WO | 2010015571 | A1 | 2/2010 |
| WO | 2014020578 | A1 | 2/2014 |

* cited by examiner

PLUG CONTACT

BACKGROUND OF THE INVENTION

Field of the Invention

The invention relates to a plug contact for making electrical contact with a circuit board by plugging the plug contact into a contact hole of the circuit board, with two contact legs which are resilient relative to one another, one terminal region and one connecting region, the connecting region connecting the two contact legs to one another and to the terminal region, and the plug contact being made from a metallic flat material.

In addition, the invention relates to an electrical supply terminal with a housing, with a conductor terminal element and with a conductor bar piece, a conductor which is to be connected being connectable in an electrically conductive manner to the conductor bar piece by means of the conductor terminal element and in the housing a conductor entry opening being made for entry of an electrical conductor which is to be connected.

Description of Related Art

Plug contacts for producing electrical connections between conductors, different electrical or electronic components and conductor bars are known in various embodiments and for various applications. For this purpose, the plug contacts are plugged into corresponding receiving contacts or socket elements, and the receiving contacts can be for example openings in conductor bars. The plug contacts themselves can be connected to electrical components or can be designed for connection to electrical conductors, for which then the terminal region of the plug contacts is made accordingly.

For the connection between a circuit board and an electrical component or the connection of a conductor to a circuit board, there are various techniques, in practice mainly soldering and press-fitting having become established. Both techniques have proven themselves over the years since they ensure good and permanent electrical contact between the contact partners. One disadvantage both of soldering and press-fitting is that the two connecting techniques are not reversible, so that a connection, once established, cannot be broken again at all or can only be broken with increased effort. Moreover, to produce the connection additional working steps and/or special tools are necessary. Here plug-and-socket connections which have been used for decades in other applications offer one alternative, since the connection can be easily established by hand and moreover can also be disconnected again if necessary, and is therefore reversible.

Electrical supply terminals have also been known for decades in a host of versions. The supply terminals can be made for example for connecting one electrical conductor or several conductors to a circuit board as a so-called printed board terminal, for which the supply terminals can have corresponding contact pins which can be soldered or press-fitted into the corresponding holes in the circuit board. The conductor terminal element can be, for example, a tension sleeve which is part of a screw terminal and by which a conductor which is to be connected can be joined in an electrically conductive manner to the conductor bar piece. Likewise, the conductor terminal element can also be made as a crimp terminal to which the stripped end of a conductor to be connected can be attached, the crimp terminal then being made on one end of the conductor bar piece and the contact pin being made on the other end of the conductor bar piece. An insulation piercing terminal in which one insulated end of a conductor is forced into the cutting edges of the insulation piercing terminal is also possible as a conductor terminal element.

Conductor terminal elements can, moreover, also be clamping springs, both loop-shaped clamping springs, so-called tension spring clamps, and also U-shaped or V-shaped clamping springs being used. Rigid conductors or conductors provided with a wire end ferrule can be plugged directly, i.e. without the clamping site having to be opened beforehand with a tool, into U-shaped or V-shaped clamping springs. In the known U-shaped or V-shaped clamping springs the conductor which is to be connected is forced by the clamping leg of the clamping spring against the conductor bar piece, as a result of which the electrical connection between the conductor and the conductor bar piece is established. To connect flexible conductors, the clamping site between the clamping leg and the conductor bar piece must be opened, for which in the housing an actuating opening is made for insertion of a tool, for example the tip of a screwdriver. The actuating opening is also used to open the clamping site in order to be able to pull a connected conductor out of the clamp again.

For some time, a plug contact which has been made for use in circuit boards has been known from practice; it is made in the manner of spring fork and has two flat contact legs which are resilient relative to one another and which are joined to one another via a common connecting region. The plug contact is punched out of a metallic flat material and bent, to produce the two contact legs, a region as narrow as possible being punched out between the contact legs. In the plugged-in state the contact legs with their two outer edges each press against the inside wall of the contact hole into which the plug contact has been plugged. The terminal region which is opposite the contact legs is made as a crimp terminal so that one conductor at a time can be connected to one plug contact.

A supply terminal with several of the above described plug contacts is known from German Patent Application DE 10 2011 011 017 A1. The individual plug contacts are arranged in several rows next to one another in chambers of the terminal housing such that the plug contacts extend perpendicular to the plane of the circuit board. To connect individual conductors, the terminal regions are made as a crimp terminal for the individual plug contacts. In this way several conductors can be connected to one circuit board in which the individual contact holes have a short distance to one another.

A fork-shaped plug contact for making contact with a circuit board is also known from German Utility Model DE 202 18 295 U1. In this plug contact the contact legs with their punching edges also press again the inside wall of the contact hole, the two contact legs each having two outside edges which when the plug contact is being forced into the contact hole of the circuit board are buried in the metal coating of the wall of the hole. Preferably, cold welds between the metal coating of the wall of the hole and the contact legs will occur in order to ensure good electrical contact. But, it is a disadvantage here that the sharp edges of the contact legs can damage the inside wall of the contact hole in the process of plugging in so that a coating, for example, of tin, which has been applied in the contact hole, is worn away after a few cycles.

FIG. 9 shows a prior art plug contact which is made in the manner of a spring fork and which has two flat contact legs of different lengths which are resilient relative to one another and which are joined to one another via a common connecting region.

SUMMARY OF THE INVENTION

The object of this invention is to make available the initially described plug contact which even for several plug-in cycles enables reliable and good contact-making with the contact hole so that the plug-in connector ensures good and permanent electrical contact between the contact partners. Moreover, an electrical supply terminal will be devised with which an electrical conductor can be easily connected to a circuit board.

This object is achieved in a plug contact of the initially described type by the two contact legs each having a contact-making region which makes contact with the contact hole in the plugged-in state, the outside contour of the two contact legs in the contact-making region each being made in the shape of a circular segment in cross section. The outside contour of the contact legs is thus machined, in particular, in the region in which the contact legs in the plugged-in state make contact with the contact hole such that it has no sharp edges which are buried in the metal coating of the wall of the hole when the plug contact is plugged into the contact hole. This makes it possible to repeatedly plug in and unplug the plug contact without damaging the inside wall of the contact hole in the circuit board.

The outside contour of the contact legs which is circular segment-shaped in cross section has a radius which is smaller than the radius of the contact hole. Advantageously, this leads to only one linear contact between the contact legs and the contact hole, instead of two linear contacts, as in the plug contacts known from the prior art in which the two contact legs make contact with the contact hole each with their two outer edges.

According to one especially preferred configuration of the plug contact in accordance with the invention, the outside contour of the two contact legs in the contact-making region is made in the shape of a circular segment not only in cross section, but in the longitudinal direction, so that the contact-making regions of the two contact legs are made crowned. The two contact legs in the contact-making region both in the plug-in direction of the contact legs and also perpendicular to the plug-in direction have a rounded outside contour so that there is only essentially one spot contact between the contact legs and the contact hole in the contact-making region.

The crowned shape of the contact-making regions can be easily produced using a die into which the contact-making regions of the contact legs are forced after punching the plug contact out of the metallic flat material or which is pressed against the contact legs. This stamping or shaping of the outside contour of the contact legs which has been produced by punching out moreover has the advantage that in doing so the roughness of the outside edges of the contact legs produced during punching are smoothed, further reducing the risk of damage of a coating which has been applied on the inside wall of one contact hole. Finally, the desired crowning of the outside contour of the contact legs can be easily produced by the stamping, and the radii of the outside contour of the contact-making regions can be dictated by the shape of the die which is being pressed against the outside of the contact legs. Preferably the radius of the circular segment-shaped outside contour in the longitudinal direction is greater than the radius of the circular segment-shaped outside contour in cross section.

According to one preferred configuration of the invention, the two contact legs have different lengths, i.e., there are a first longer contact leg and a second shorter contact leg. On the free end of the longer contact leg a guide segment is formed which in the plug-in direction of the plug contact is located upstream of the free end of the shorter contact leg. The guide segment is used here as an insertion and centering aid when the plug contact is being plugged into the corresponding contact hole in a circuit board. For this purpose, the guide segment on its side facing away from the connecting region and thus facing the contact hole when being plugged in has a wedge-shaped or semicircular outside contour. When the plug contact is being plugged into the contact hole, thus, the guide segment of the first longer contact leg slides first into the contact hole before the second shorter contact leg also dips into the contact hole, the two contact legs then being forced onto one another by the contact wall of the contact hole as plugging-in proceeds so that the distance between the two contact legs is reduced compared to the unplugged state.

In a first version of the plug contact in accordance with the invention, the two contact legs extend in one plane, the direction of primary extension of the plug contact running parallel to the plug-in direction. According to a second version of the plug contact, the two contact legs are bent at an angle, the two contact legs each having a first region and a second region which are located at an angle c to one another. Preferably, the angle c between the two regions of the contact legs is roughly 90° so that the contact legs are bent roughly L-shaped. The respectively first region of the two contact legs is connected to the connecting region, while the contact-making regions are made on the second regions and the ends of the second regions form the free ends of the contact legs with which the contact legs are plugged forward into the corresponding contact hole in the circuit board.

The angling of the contact legs reduces the overall height of the plug contact. Moreover, a plug contact with angled contact legs has the advantage that the working region of the plug contact which is active when the contact legs are plugged into the contact hole, i.e., the region which produces the reset force of the plug contact, lies essentially in the first region of the contact legs. In this region, the contact legs are loaded primarily in torsion and not bending; this leads to the plug contact being more elastic compared to a plug contact with straight contact legs which are not angled. The plug contact can thus be more easily plugged into a contact hole or pulled out of the contact hole again.

Regardless of whether the two contact legs are bent or extend in one plane, there are various possibilities for how the terminal region of the plug contact in accordance with the invention can be made. According to a first version the terminal region is made as a crimp terminal by means of which the stripped end of a conductor to be connected can be electrically connected. Alternatively, the terminal region can also be made as an insulation piercing terminal so that the terminal region has two cutting edges opposite one another between which the insulated end of a conductor to be connected is forced so that the cutting edges penetrate the insulation of the conductor and make contact with the metal conductor.

According to another preferred configuration of the plug contact in accordance with the invention, the terminal region is made as a flat conductor bar which together with a tension sleeve forms a screw terminal or together with a clamping spring forms a spring force clamping terminal. In order to increase the surface pressure between the plugged-in conductor and the conductor bar, preferably several grooves or notches are made on the side of the conductor bar facing the conductor, as a result of which the contact resistance between the conductor and the current bar is reduced.

The initially named object is achieved in the electrical supply terminal in that has a plug contact in accordance with the invention which is located at least partially in the housing of the supply terminal such that the conductor bar piece is formed by the terminal region of the plug contact, and the contact legs of the plug contact with their contact-making regions protrude out of the bottom of the housing. The bottom of the housing is considered the side which is facing the circuit board when the supply terminal is being mounted on the circuit board. With respect to the advantages of the electrical supply terminal in accordance with the invention, reference is made to the above statements in conjunction with the plug contact in accordance with the invention.

To connect a conductor to the supply terminal, different connecting techniques can be used, i.e., the plug contact in accordance with the invention can be used in supply terminals with different connecting techniques or different conductor terminal elements. According to one preferred configuration, the conductor terminal element is a clamping spring which has one clamping leg and one contact leg, the clamping leg together with the terminal region of the plug contact forming a spring force clamping terminal for the conductor which is to be connected. The use of a clamping spring as a conductor terminal element has the additional advantage that a conductor to be connected via the spring force clamping terminal can be very easily connected to the supply terminal and thus also to the circuit board. If necessary, the electrical conductor can moreover also be pulled out of the supply terminal again when the spring force clamping terminal is being opened. The electrical connection between the conductor and the circuit board can thus be broken both between the conductor and the terminal region of the plug contact and also between the contact legs of the plug contact and the circuit board.

According to one alternative configuration, the electrical supply terminal can for example also be made as a screw terminal so that in the housing there is a tension sleeve which together with the terminal region of the plug contact which is made, for this purpose, as a flat conductor bar forms a screw terminal for the conductor which is to be connected. The tension sleeve is actuated using a screw which is accessible via an actuating opening in the housing of the supply terminal. Alternatively, the conductor terminal element can also be made as a crimp terminal to which the stripped end of a conductor which is to be connected can be attached.

If, in the electrical supply terminal, the terminal region extends in the longitudinal direction of the contact legs, the conductor entry opening is located on the top of the housing and an electrical lead which is to be connected is plugged into the supply terminal perpendicular to the plane of the circuit board. But, in addition, it is also possible for the terminal region of the plug contact to be bent perpendicular or at an angle not equal to 90° to the longitudinal direction of the contact legs so that the conductor entry opening is then located accordingly on one front side of the housing.

According to another advantageous configuration, for simple mounting of the electrical supply terminal on a circuit board, it is provided that on the bottom of the housing several adjusting elements are made which when the supply terminal is being mounted on the circuit board are inserted into corresponding recesses in the circuit board. The ends of the adjusting elements are made preferably conical; this facilitates the insertion of the adjusting elements into the corresponding recesses in the circuit board. Moreover, the length of the adjusting elements is chosen in such a way that when the supply terminal is being mounted on the circuit board first the adjusting elements with their free ends engage the corresponding recesses in the circuit board before the contact-making regions of the contact legs of the plug contact dip into the corresponding contact holes in the circuit board.

According to another configuration of the electrical supply terminal in accordance with the invention, in addition to the adjusting elements, at least two locating elements are made on the bottom of the housing and engage corresponding recesses in the circuit board. Corresponding locating projections or locating lugs can ensure that the electrical supply terminal after mounting on a circuit board is reliably fastened to the latter. Preferably, the locating elements are made such that they can be shifted out of a first unlatched state into a second latched state and vice versa. In this way, it is possible to release the latching between the housing of the electrical supply terminal and the circuit board again so that the electrical supply terminal can also be lifted off the circuit board again.

In particular, there is at this point a host of possibilities for configuring and developing the plug contact in accordance with the invention and the electrical supply terminal in accordance with the invention as will be apparent from the following description in conjunction with the accompanying drawings.

Figure 2:
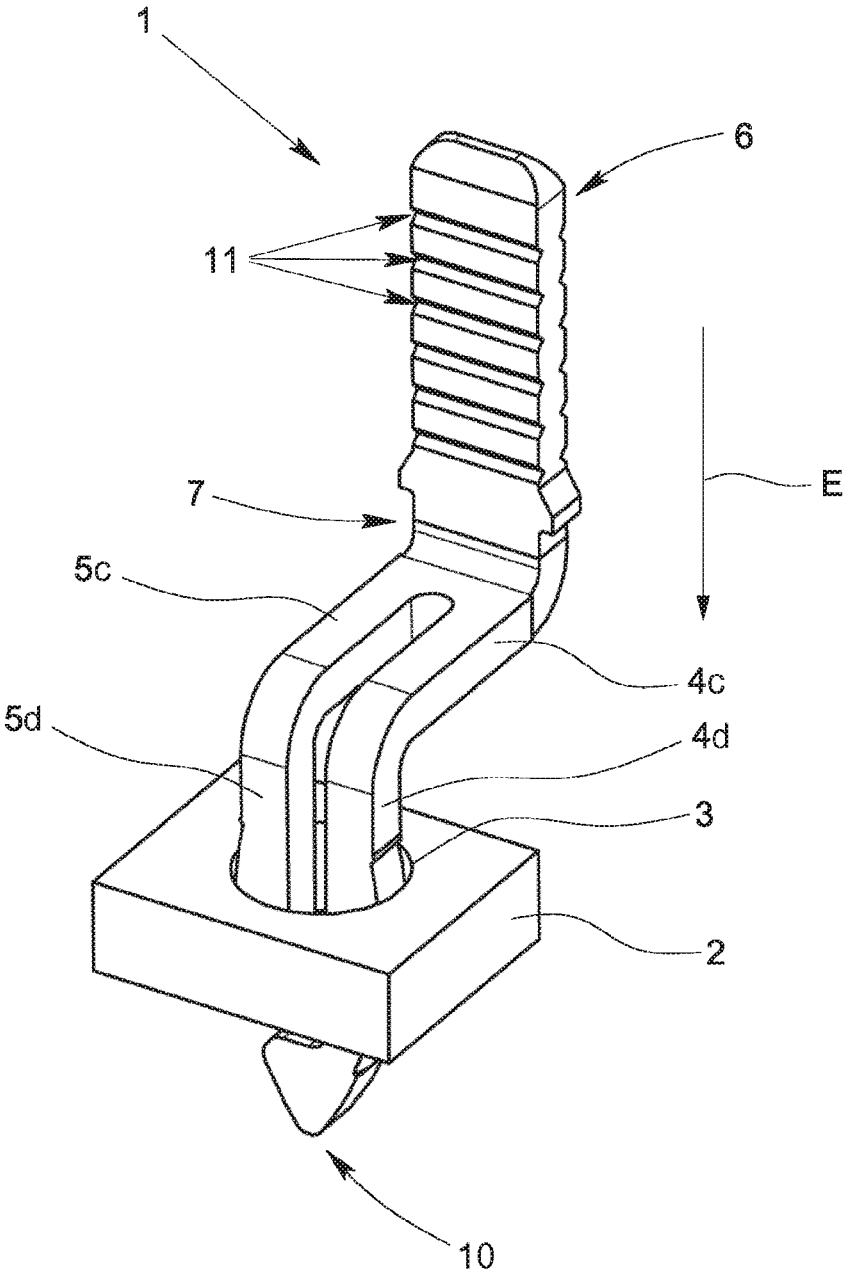
FIG. 2 shows an extract of a circuit board with a plug contact inserted into a contact hole according to FIG. 1.
Figure 9:
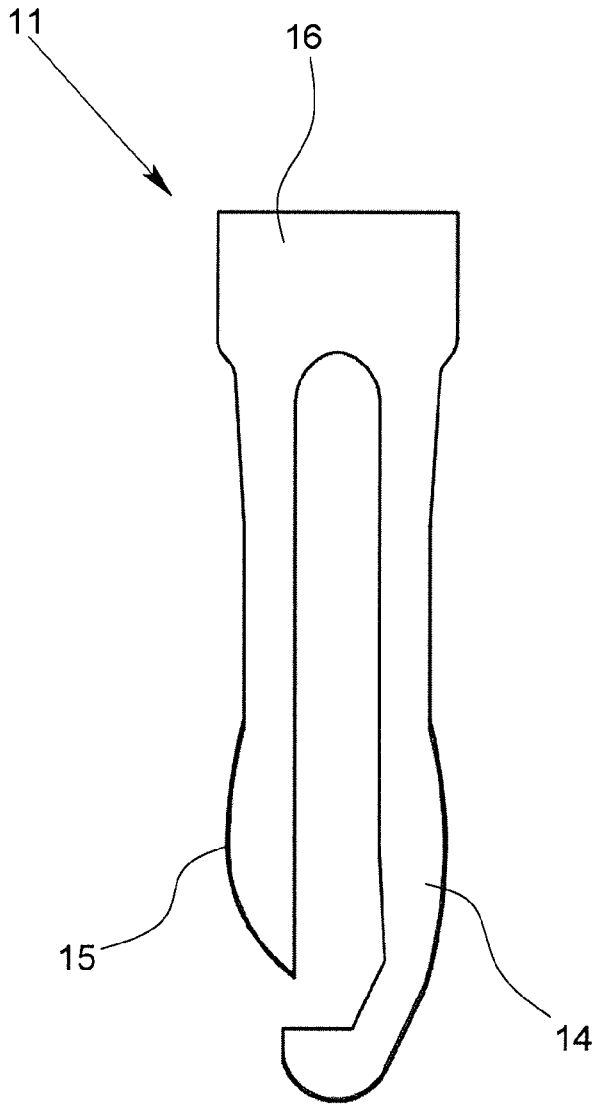
Fig. 9 (Prior Art)
FIG. 9 is a plan view showing a representation of a plug-in contact known from the prior art.

The known plug-in contact 11 which is shown in FIG. 9 has two contact legs 14, 15 which are connected to one another via a common connecting region 16, the contact legs 14, 15 extending from the connecting region 16 in a plug-in direction E (FIG. 2) of the plug-in contact 11. In the known plug-in contact 11, the two contact legs 14, 15 are produced by the region between the contact legs 14, 15 being punched out when the plug-in contact 11 is being punched out. As FIG. 9 shows, the width of the region which has been punched out between the two contact legs 14, 15 is somewhat greater than the width of the two contact legs 14, 15. The width of the individual contact legs 14, 15 thus corresponds respectively to only barely ⅓ of the total width of the plug-in contact 1 in the plugged-in state, and thus, also to only barely ⅓ of the diameter of the contact hole 3 in the circuit board 2 into which the plug-in contact 11 is to be plugged (FIG. 2). For small hole diameters, this leads to the contact legs 14, 15 of the plug-in contact 11 being made very narrow and also very thin; this leads to the normal contact force which is being applied by the contact legs 14, 15 being only relatively small.

DETAILED DESCRIPTION OF THE INVENTION

Figure 1:
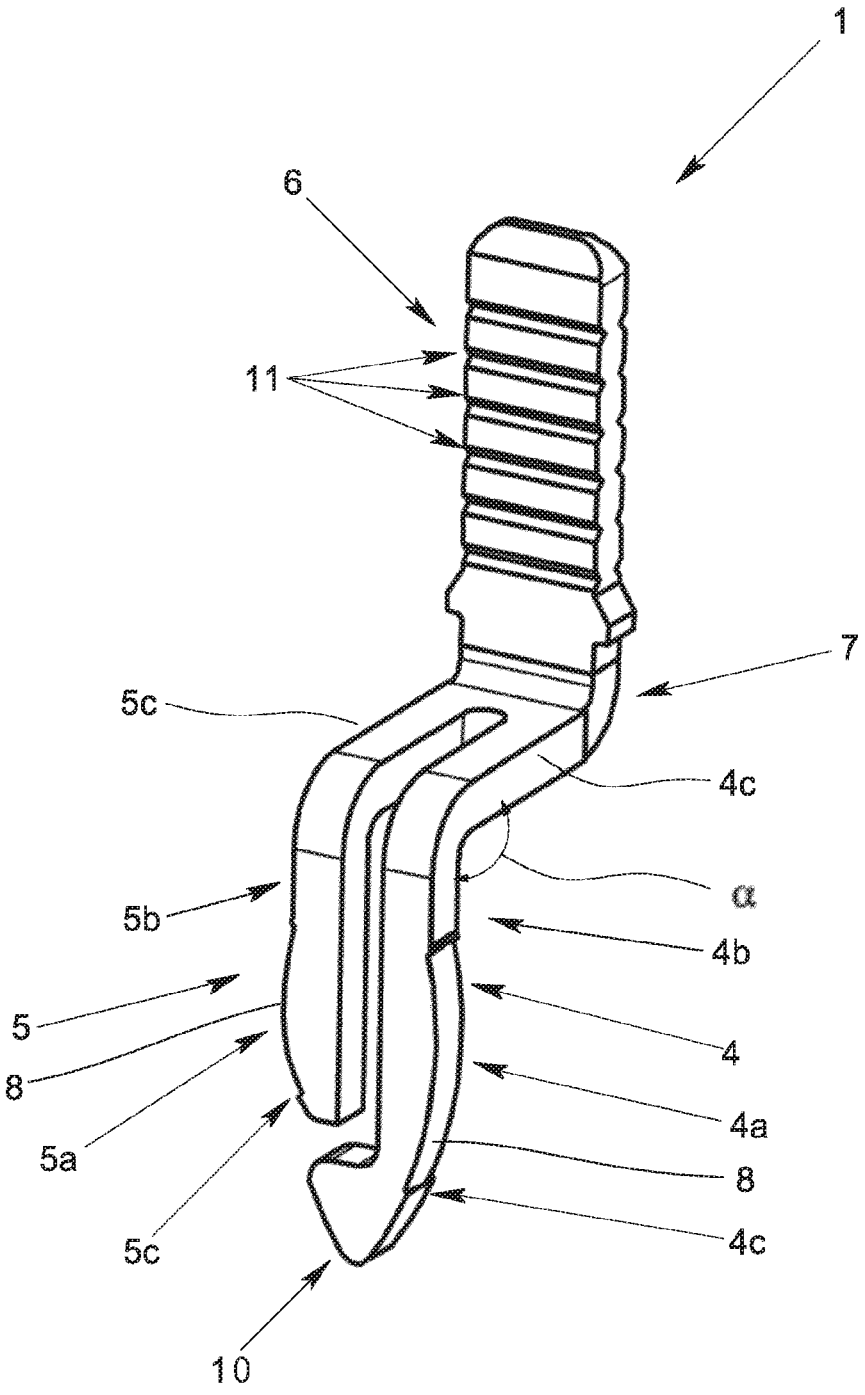
FIG. 1 shows a perspective view of an exemplary embodiment of a plug contact in accordance with the invention.

FIGS. 1 and 2 show a plug contact 1 for making contact with a circuit board 2, for which the plug contact 1 is plugged into a corresponding contact hole 3 in the circuit board 2. The plug contact 1 which is punched out of a metallic flat material and bent has two contact legs 4, 5 which are resilient relative to one another, having a terminal region 6 and a connecting region 7, the two contact legs 4, 5 being connected to one another and to the terminal region 6 via the connecting region 7.

Figure 3:
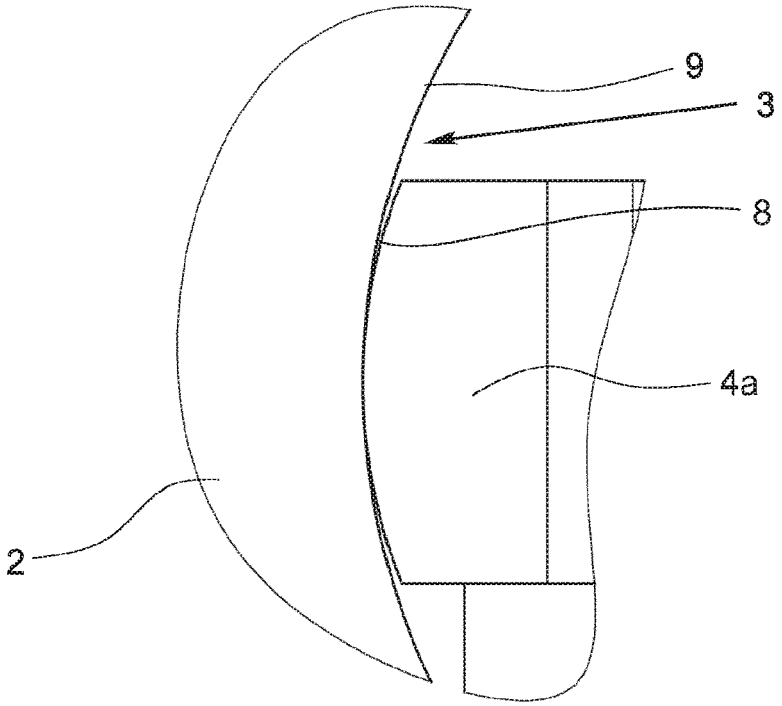
FIG. 3 shows an enlarged detail of a contact leg plugged into a contact hole, in cross section.

The contact legs 4, 5 each have one contact-making region 4*a*, 5*a* which makes contact with the contact hole 3 in the plugged-in state according to FIG. 2, the outside contour 8 of the two contact legs 4, 5 in the contact-making region 4*a*, 5*a* each being made in the shape of a circular segment in cross section, as is apparent according to FIG. 3 from the enlarged cross section of one contact leg 4 plugged into a contact hole 3. Here it is also apparent that the radius of the outside contour 8 of the contact leg 4 is somewhat smaller than the radius of the contact hole 3 so that when the contact legs 4, 5 are plugged into the contact hole 3 the inside wall 9 of the contact hole 3 is not damaged. This leads to a plug contact 1 which has been made in this way enabling clearly more plugging and unplugging cycles than a plug contact in which the outside contour of the contact legs is straight in cross section. In a plug contact whose contact legs have a straight outside contour in the contact-making region, after a few plugging-in cycles, grooves form in the inside wall 9 of the contact hole 3 so that the surface of the inside wall 9 of the contact hole 3 is damaged, in particular when it has a coating.

FIGS. 1 and 2 moreover show that the outside contour 8 of the two contact legs 4, 5 in the contact-making region 4*a*, 5*a*, is also made in the shape of a circular segment in the longitudinal direction so that the contact-making regions 4*a*, 5*a* are made crowned. The contact-making regions 4*a*, 5*a* thus make contact with the inside wall 9 of the contact hole 3 only with their center region so that ideally there is only one spot contact between the contact legs 4, 5 and the contact hole 3. In practice this theoretical spot contact becomes larger due to the surface pressure between the contact legs 4, 5 and the inside wall 9 of the contact hole 3 on small essentially circular surfaces. Since the contact-making regions 4*a*, 5*a* do not have sharp edges which touch the inside wall 9 of the contact hole 3 due to the crowned execution, damage to the inside wall 9 of the contact hole 3 when the plug contact 1 is being plugged in and unplugged is avoided. For this reason there remains a coating for example of tin applied to the inside wall 9, even after several plugging and unplugging cycles of the plug contact 1 in accordance with the invention.

In the exemplary embodiments of the plug contact 1 in accordance with the invention which are shown in the figures, the two contact legs 4, 5 have different lengths, on the free end 4*b* of the longer contact leg 4 a guide segment 10 being located which in the plug-in direction E of the plug contact 1 is located upstream of the free end 5*b* of the shorter second contact leg 5. The guide segment 10 is used here as an insertion and centering aid when the plug contact 1 is being plugged into the corresponding contact hole 3 of a circuit board 2. For this purpose the guide segment 10 on its side which faces away from its terminal region 6 and which faces the contact hole 3 when being plugged in has a wedge-shaped outside contour which dips first into the contact hole 2 when the plug contact 1 is being plugged in.

In the exemplary embodiments of the plug contact 1 in accordance with the invention which are shown in FIGS. 1, 2, 4 and 7, the two contact legs 4, 5 each have a first region 4*c*, 5*c* and a second region 4*b*, 5*b* which are located at an angle α to one another. The angle α in the exemplary embodiments shown in the figures is roughly 90° so that the two contact legs 4, 5 are bent roughly L shaped. The first two regions 4*c*, 5*c* of the contact legs 4, 5 which run horizontally in the alignment shown in the figures, connect to the connecting region 7, while the ends of the two second regions 4*d*, 5*d* form the free ends 4*b*, 5*b* of the contact legs 4, 5. The contact-making regions 4*a*, 5*a* are made on the second regions 4*d*, 5*d*, the width of the plug contact 1 being greatest in the zone of the contact-making regions 4*a*, 5*a* so that in the plugged-in state of the plug contact 1 the two contact legs 4, 5 are bent at maximum onto one another so that the normal contact force between the contact legs 4, 5 and the contact hole 3 is also maximum.

The plug contact 1 which is shown in FIGS. 1 and 2 differs from the two versions of the plug contact 1 which are shown in FIG. 4 by a different configuration of the terminal region 6.

Figure 4A:
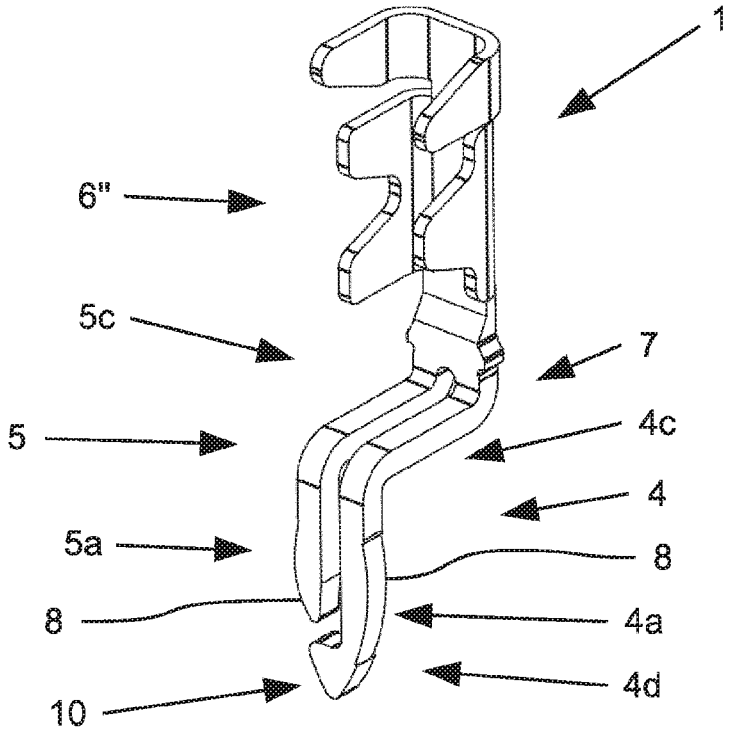
FIGS. 4*a* & 4*b* show two alternative exemplary embodiments of the plug contact according to FIG. 1, FIGS. 5*a* & 5*b* each show one of the two versions of the two plug contacts shown in FIGS. 4*a* & 4*b*.
Figure 4B:
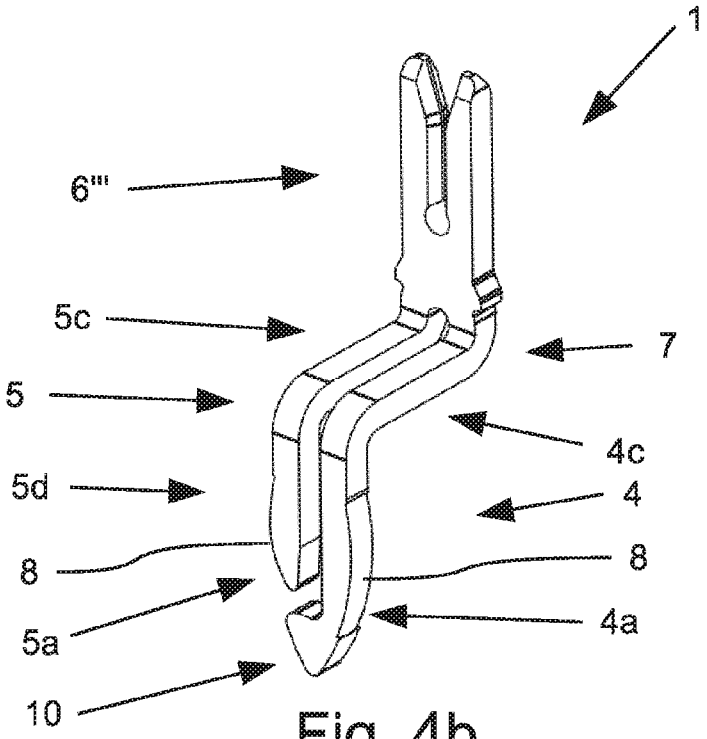

While in the embodiment shown in FIGS. 1 and 2 the terminal region 6 is made as a flat conductor bar 6', the terminal region 6 in the exemplary embodiment according to FIG. 4*a* is made as a crimp terminal 6" and in the exemplary embodiment according to FIG. 4*b* as an insulation piercing terminal 6'''. In order to increase the surface pressure between a connected conductor and the conductor bar 6, the latter on the side facing the conductor has several grooves 11. Depending on the type of execution of the terminal region 6, an electrical conductor can thus be electrically connected to the plug contact 1 in different ways.

Figure 5A:
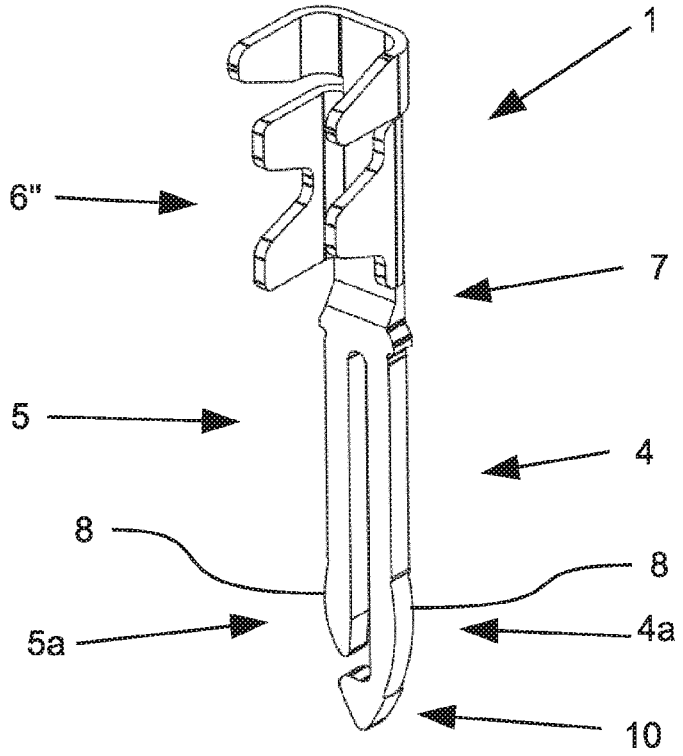
Figure 5B:
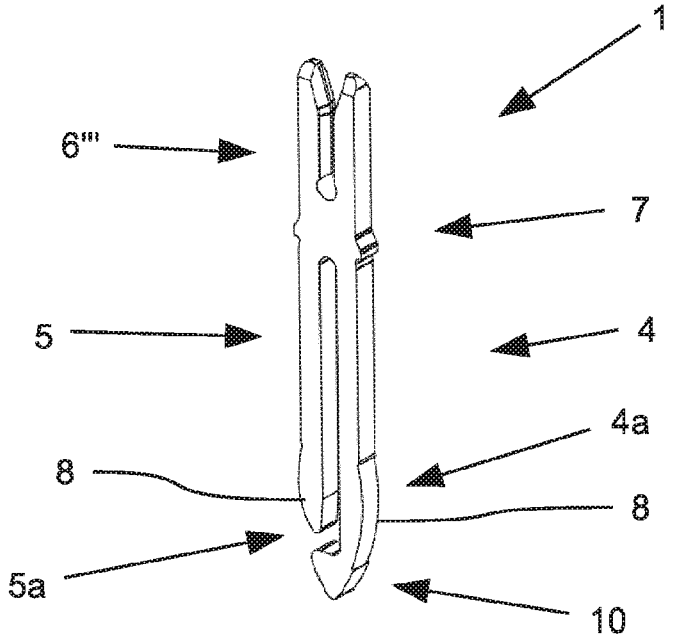

FIG. 5 shows one version each of the two plug contacts 1 shown in FIG. 4, in which the two contact legs 4, 5 of the plug contact 1 are not bent, but extend in one plane. In the plug contact 1 according to FIG. 5*a* the terminal region 6—corresponding to the plug contact 1 according to FIG. 4*a*—is made as a crimp terminal 6", while in the plug contact 1 according to FIG. 5*b*—corresponding to the plug contact 1 according to FIG. 4*b*—the terminal region 6 is made as an insulation piercing terminal 6'''. The possible execution of the terminal region 6 is thus independent of whether the contact legs 4, 5 are bent or extend in one plane.

Figure 6:
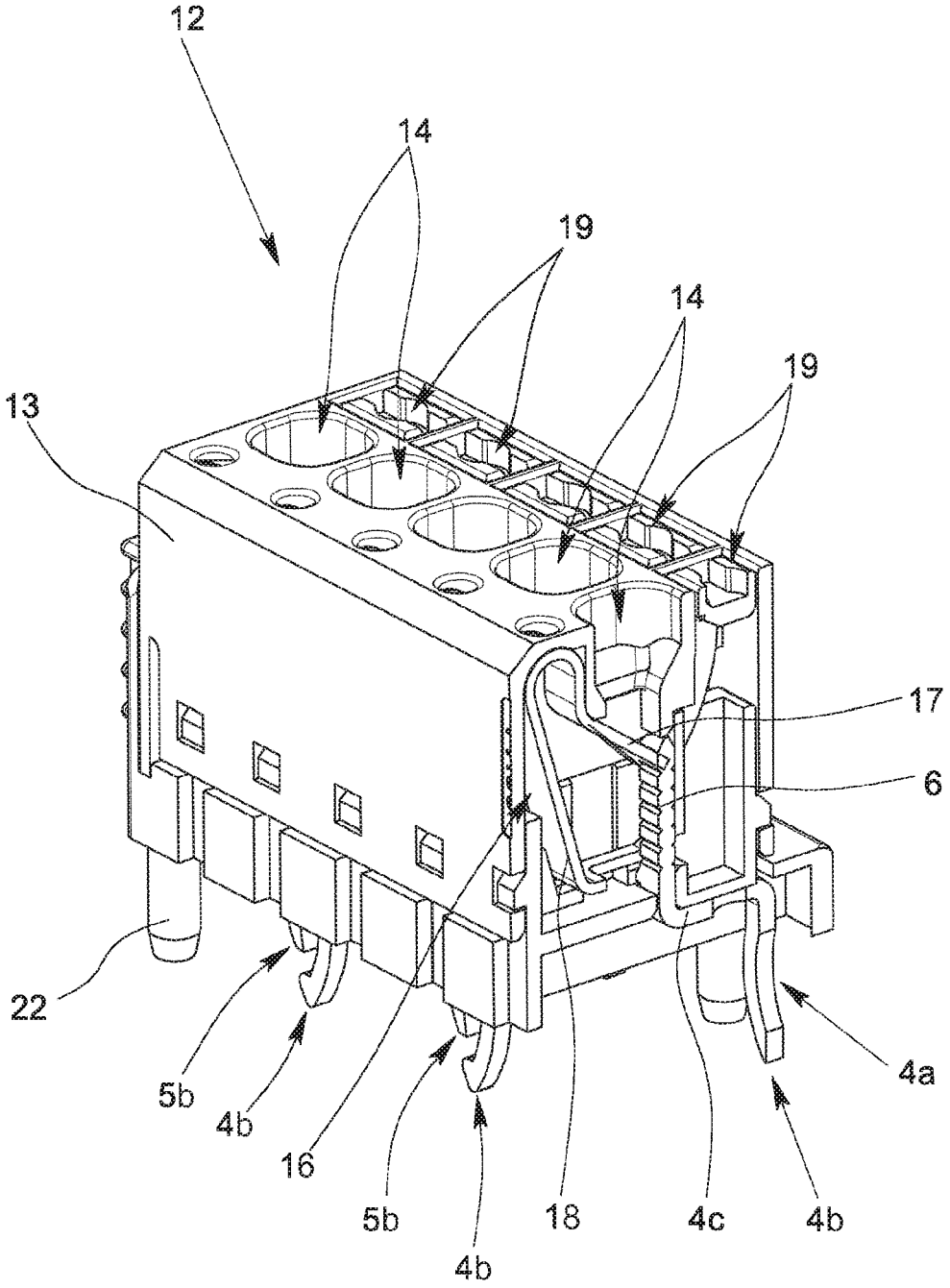
FIG. 6 shows one exemplary embodiment of an electrical supply terminal in accordance with the invention, in cross section.

FIG. 6 shows one preferred exemplary embodiment of an electrical supply terminal 12 in accordance with the invention which has a housing 13 which generally is made of plastic. In the housing 13, there are several conductor entry openings 14 and a corresponding number of plug contacts 1, the contact legs 4, 5 of the individual plug contacts 1 protruding with their contact-making regions 4*a*, 5*a* out of the bottom 15 of the housing 13 facing a circuit board 2.

In the illustrated exemplary embodiment, in the housing 13 of the supply terminal 12, moreover, there are a number of clamping springs 16 corresponding to the number of plug contacts 1 as conductor terminal elements which each have one clamping leg 17 and one contact leg 18. Here, each clamping spring 16 is assigned one plug contact 1 such that the terminal region 6 of one plug contact 1 made as a flat conductor bar 6' together with the free end of the clamping leg 17 of the clamping spring 16 forms a spring force clamping terminal for an electrical conductor which has been inserted into the housing 13 through a conductor entry opening 14. Since the supply terminal 12 is designed for connection of five conductors, in the housing 13 accordingly five conductor entry openings 14 are also made. To open the individual spring force clamping terminals, moreover, there are five actuating pushers 19 movably located in the housing 13. If one actuating pusher 19 is forced into the interior of the housing 13, the actuating pusher 19 deflects the clamping leg 17 of the clamping spring 16 against its spring force so that the clamping site is opened and thus a connected conductor can be pulled out of the clamping site. If the clamping site is opened using the actuating pusher 19, a flexible conductor can moreover also be inserted into the clamping site.

Figure 7A:
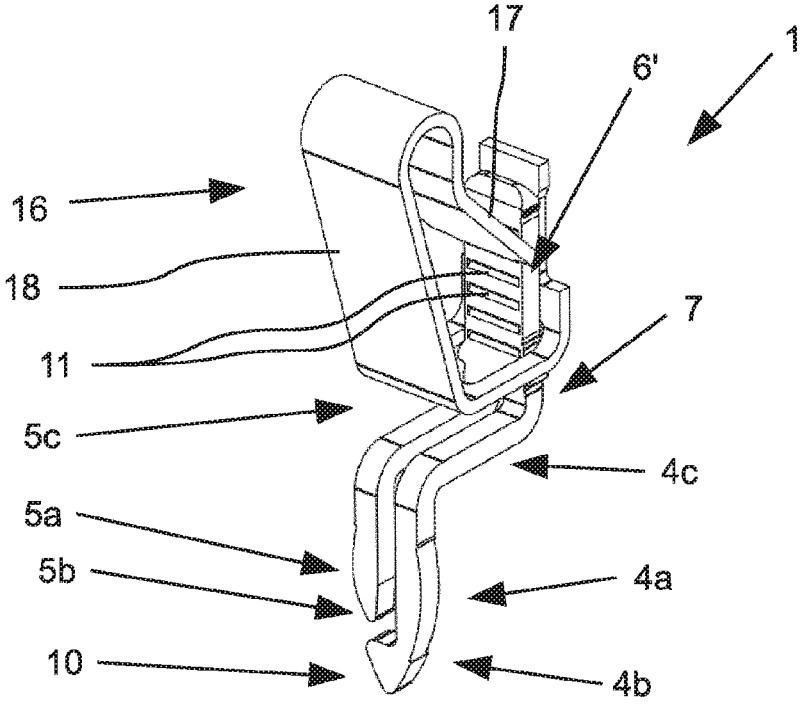
FIGS. 7*a* & 7*b* show two representations of the plug contact according to FIG. 1 with two different conductor terminal elements, FIGS. 8*a* & 8*b* each show one version of the two plug contacts shown in FIG. 7, with two different conductor terminal elements.
Figure 7B:
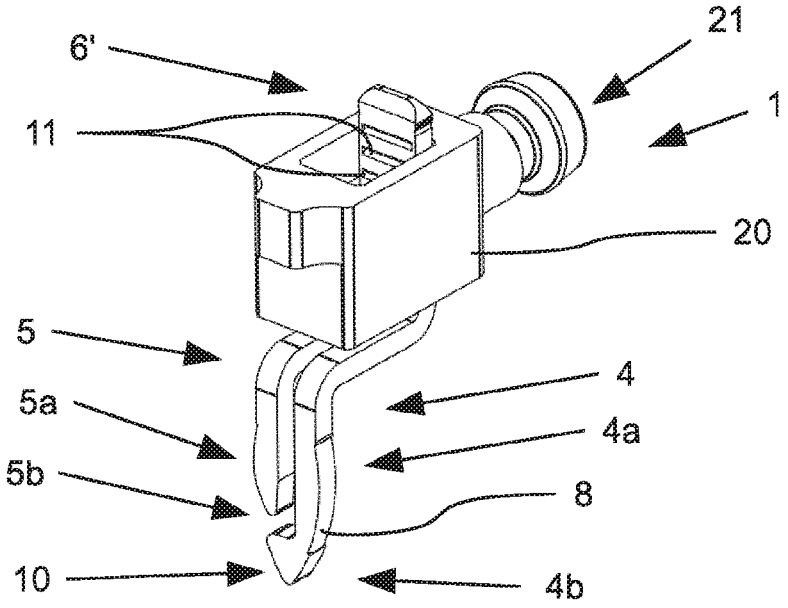
Figure 8A:
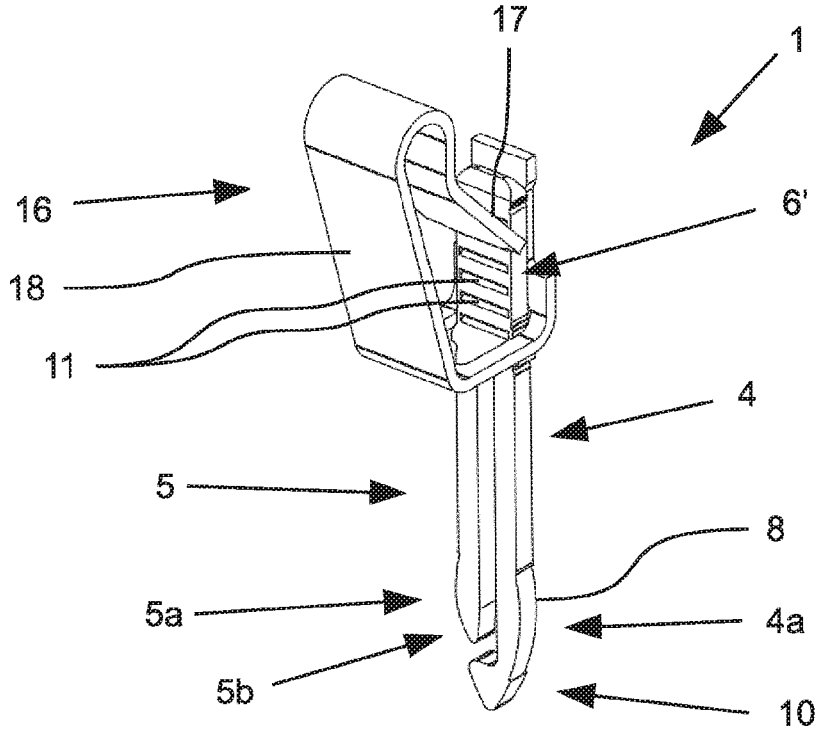
Figure 8B:
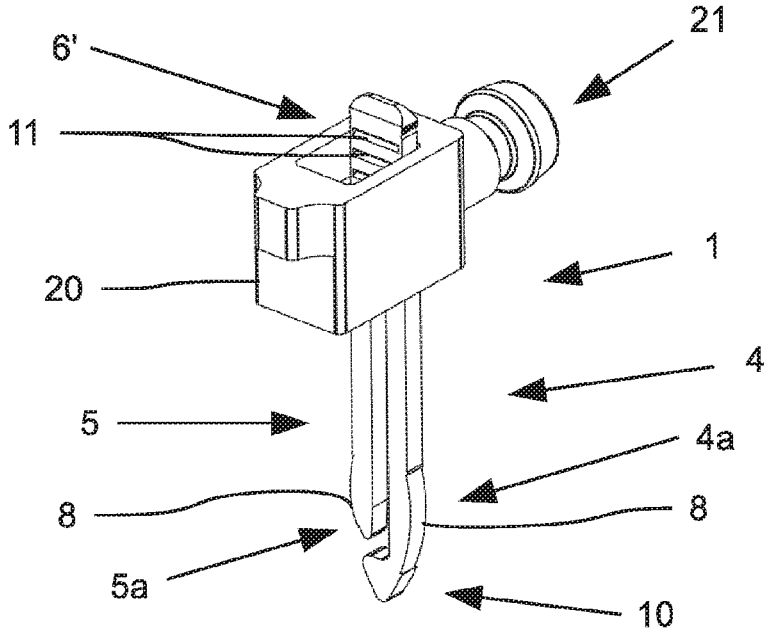

As an alternative to the configuration shown in FIG. 6 with one clamping spring 16 as a conductor terminal element, the supply terminal 12 can also have a tension sleeve 20 as a conductor terminal element which, together with the terminal region 6 of one plug contact 1, forms a screw terminal for an electrical conductor which is to be connected. These two possible alternative types of terminals—spring force clamping terminal and screw terminal—are shown in FIGS. 7*a*, 7*b* and 8*a*, 8*b*, there only one plug contact 1 at a time together with one clamping spring 16 (FIGS. 7*a* and 8*a*) or with one tension sleeve 20 (FIGS. 7*b* and 8*b*) being shown, therefore, without the housing which accommodates the plug contact 1 and the respective conductor terminal element. FIGS. 7*a*, 7*b* show two plug contacts 1 according to FIGS. 1 and 2, in which the two contact legs 4, 5 each are bent L-shaped. In contrast, in the two exemplary embodiments according to FIGS. 8*a*, 8*b* the plug contacts 4, 5 are not bent, but extend continuously in one plane, specifically in the plug-in direction E. The screw terminal which is shown in FIGS. 7*b* and 8*b*, moreover, has another screw 21 with which the screw terminal can be actuated so that the stripped end of the conductor which has been inserted into the tension sleeve 20 is pulled by means of the tension sleeve 20 against the conductor bar 6'.

To fasten the housing 13 of the electrical supply terminal 12 on a circuit board 2, on the bottom 15 of the housing 13 several adjusting elements 22 located offset to one another are made which each project beyond the bottom 15 of the housing 13 and can be inserted into corresponding recesses in a circuit board 2. Moreover, on the housing 13 suitable latching elements with which the housing 13 can be latched on a circuit board can also be made.

What is claimed is:

1. A plug contact for making electrical contact with a circuit board by plugging the plug contact into a contact hole of the circuit board, comprising:

two contact legs which are resilient relative to one another, a terminal region and a connecting region, the connecting region connecting the two contact legs to one another and to the terminal region, wherein each of the two contact legs have a contact-making region for making contact with the contact hole in the plugged-in state, wherein the two contact legs have an outside contour in the contact-making region which is circular segment-shaped in cross section, a radius of the outside contour being smaller than a radius of a corresponding contact hole of the circuit board, wherein the contact legs extend from the connecting region spaced from each other all of the way to free ends thereof, wherein the circular segment-shape of the outside contour of the two contact legs in the contact-making region extends in a longitudinal direction of the contact legs so that the contact-making regions are longitudinally crowned, and wherein a radius of the circular segment-shaped outside contour in the longitudinal direction is greater than a radius of the circular segment-shaped outside contour in the cross section.

2. The plug contact as claimed in claim 1, wherein the two contact legs have different lengths, a guide segment being provided on the free end of a longer one of the contact legs and being located upstream of the free end of a shorter one of the contact legs in a plug-in direction.

3. The plug contact as claimed in claim 1, wherein each of the two contact legs has a first region and a second region which are located at an angle c relative to one another so that the two contact legs are bent it a generally L-shaped configuration, the first regions connecting to the connecting regions which are located on the second regions.

4. The plug contact as claimed in claim 1, wherein the terminal region is a flat conductor bar which has several grooves or notches on one side.

5. The plug contact as claimed in claim 1, wherein the terminal region is one of a crimp terminal or an insulation piercing terminal.

6. The plug contact as claimed in claim 1, wherein each of the two contact legs has a first region extending from the connecting region and out of a lengthwise plane of the terminal region, a second region located at an angle relative to the first region and generally parallel to said lengthwise plane so that the first and second regions have a generally L-shaped configuration, and wherein the longitudinally crowned outside contour is located in the second region.

7. An electrical supply terminal, comprising:

a housing, a plug contact, a conductor terminal element, and a conductor bar piece, wherein a conductor being connectable to the conductor bar piece in an electrically conductive manner by the conductor terminal element wherein the housing has a conductor entry opening for entry of an electrical conductor which is to be connected, wherein the plug contact comprises:

two contact legs which are resilient relative to one another and have a contact-making region for making contact with a contact hole of a circuit board in a plugged-in state, each of the two contact legs having an outside contour in the contact-making region which is circular segment-shaped in cross section, a radius of the outside contour being smaller than a radius of a corresponding contact hole of the circuit board, a terminal region and a connecting region, the connecting region connecting the two contact legs to one another and to the terminal region, the legs extending from the connecting region in spaced relationship to each other all of the way to free ends thereof, wherein the circular segment-shape of the outside contour of the two contact legs in the contact-making region extends in a longitudinal direction of the contact legs so that the contact-making regions are longitudinally crowned, wherein the radius of the circular segment-shaped outside contour in the longitudinal direction is greater than the radius of the circular segment-shaped outside contour in the cross section, and wherein the plug contact is located in the housing such that the conductor bar piece is formed by the terminal region of the plug contact and the contact-making regions of the contact legs protrude from a bottom of the housing in a direction for connection to a circuit board.

8. The electrical supply terminal as claimed in claim 7, wherein the conductor terminal element is a clamping spring in the housing, the clamping spring having a clamping leg and a contact leg, the clamping leg forming, with the terminal region of the plug contact, a spring force clamping terminal for an electrical conductor which is to be connected.

9. The electrical supply terminal as claimed in claim 7, wherein a tension sleeve in the housing forms the conductor terminal element, the tension sleeve, together with the terminal region of the plug contact, forming a screw terminal for an electrical conductor which is to be connected.

10. The electrical supply terminal as claimed in claim 7, wherein several adjusting elements are provided on a bottom of the housing for insertion into corresponding recesses in a circuit board.

* * * * *